US006398672B1

(12) United States Patent
Olson

(10) Patent No.: US 6,398,672 B1
(45) Date of Patent: Jun. 4, 2002

(54) FOOTBALL KICKING TRAINER

(76) Inventor: Kenneth R. Olson, 17415 E. Chestnut Dr., Queen Creek, AZ (US) 85242

( * ) Notice: Subject to any disclaimer, the term of this patent is extended or adjusted under 35 U.S.C. 154(b) by 0 days.

(21) Appl. No.: 09/710,640

(22) Filed: Nov. 8, 2000

Related U.S. Application Data

(60) Provisional application No. 60/164,725, filed on Nov. 12, 1999.

(51) Int. Cl.[7] ..... A63B 69/00

(52) U.S. Cl. ..... 473/439; 473/470; 473/492; 273/348; 273/407

(58) Field of Search ..... 473/415, 419, 473/420, 422, 454–456, 470–473, 490–495, 197, 438, 439, FOR 115, FOR 116, FOR 118, FOR 124, FOR 126; 273/348, 348.4, 398, 399, 400, 401, 407; 40/404, 406

(56) References Cited

U.S. PATENT DOCUMENTS 2,657,058 A * 10/1953 Mulcahy ..... 473/436
3,647,214 A * 3/1972 Hohmann ..... 273/392
4,068,846 A 1/1978 Forrest ..... 273/55
4,201,385 A * 5/1980 Szabados ..... 273/410
4,247,116 A * 1/1981 McQuary ..... 273/404
4,437,661 A 3/1984 Chavez ..... 273/55
4,978,121 A * 12/1990 Larkey ..... 473/454
5,193,802 A 3/1993 Saltus ..... 273/26
5,249,796 A 10/1993 Silvi ..... 273/55
5,271,616 A * 12/1993 Grimaldi ..... 473/432
5,513,843 A 5/1996 Russell ..... 273/55
5,573,239 A * 11/1996 Ryker et al. ..... 473/436
5,588,645 A * 12/1996 Schwan et al. ..... 473/456
5,803,842 A * 9/1998 Ross ..... 473/456

* cited by examiner

*Primary Examiner*—Paul T. Sewell
*Assistant Examiner*—Mitra Aryanpour

(57) ABSTRACT

This device is a portable training apparatus for the evaluation of the flight trajectory and the horizontal and vertical vectors comprising the flight path of a kicked football at any distance, the device having a portable wheeled base, rigid uprights and movable trajectory indicator which may be set for optimum trajectory angle.

3 Claims, 3 Drawing Sheets

FOOTBALL KICKING TRAINER

Priority is claimed to Provisional Patent Application Ser. No. 60/164,725 filed Nov. 12, 1999.

I. BACKGROUND OF THE INVENTION

1. Field of the Invention

This device is a portable training apparatus for training football kickers and for the determination of the evaluation of the flight trajectory of a kicked football at any distance, the device having a portable wheeled base, rigid uprights and a movable trajectory indicator which may be adjusted and set for optimum trajectory angle.

2. Description of Prior Art

The following United States Patents are disclosed and incorporated within this provisional patent application. In U.S. Pat. No. 5,513,843 to Russell, a football and soccer goal device and a kicking pad is disclosed, the goal made of pipe and netting and the pad made of a kicking tee within a holding rod for independent use without another person required to hold the ball. In U.S. Pat. No. 5,249,796 to Silvi, another convertible sports goal is disclosed. A portable, asymmetrically displaced, self-centering ball catching and return apparatus and method is disclosed, incorporating a loosely hung net with a target for kicking a ball to the target on the net, is disclosed in U.S. Pat. No. 5,193,802 to Saltus. A miniature football goalpost with a loose net attached on the bottom ballast of the goalpost, utilizing a light-weight football is disclosed in U.S. Pat. No. 4,437,661 to Chavez. Another football kicking net, very similar to the Saltus patent, with the exception of the incorporation of a loose kicking pocket within the net, is disclosed in U.S. Pat. No. 4,068,846 to Forrest. While these patents disclose kick training devices and toys, they do not disclose the elements of the present invention, including the adjustability of the device for use at any distance, having adjustment for the optimum vertical trajectory, and it does not incorporate the portability and storage elements of the current invention.

II. SUMMARY OF INVENTION

The primary objective of the invention is to provide a portable kicking training device which a person wanting to develop a consistently accurate kicking trajectory may use, without assistance, to improve their kicking skills. The device incorporates a storage base having wheels, a pair of removable uprights for compact storage within the base, a mounting means for the uprights, a moveable horizontal trajectory indicator attached to the two uprights, vertically slidable up and down the uprights depending on the distance the user chooses to practice, and a plurality of vertically aligned contact indicators hanging from the horizontal trajectory indicator. The device is wholly contained within the storage base when disassembled.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

IV. DESCRIPTION OF THE PREFERRED EMBODIMENT

Figure 1:
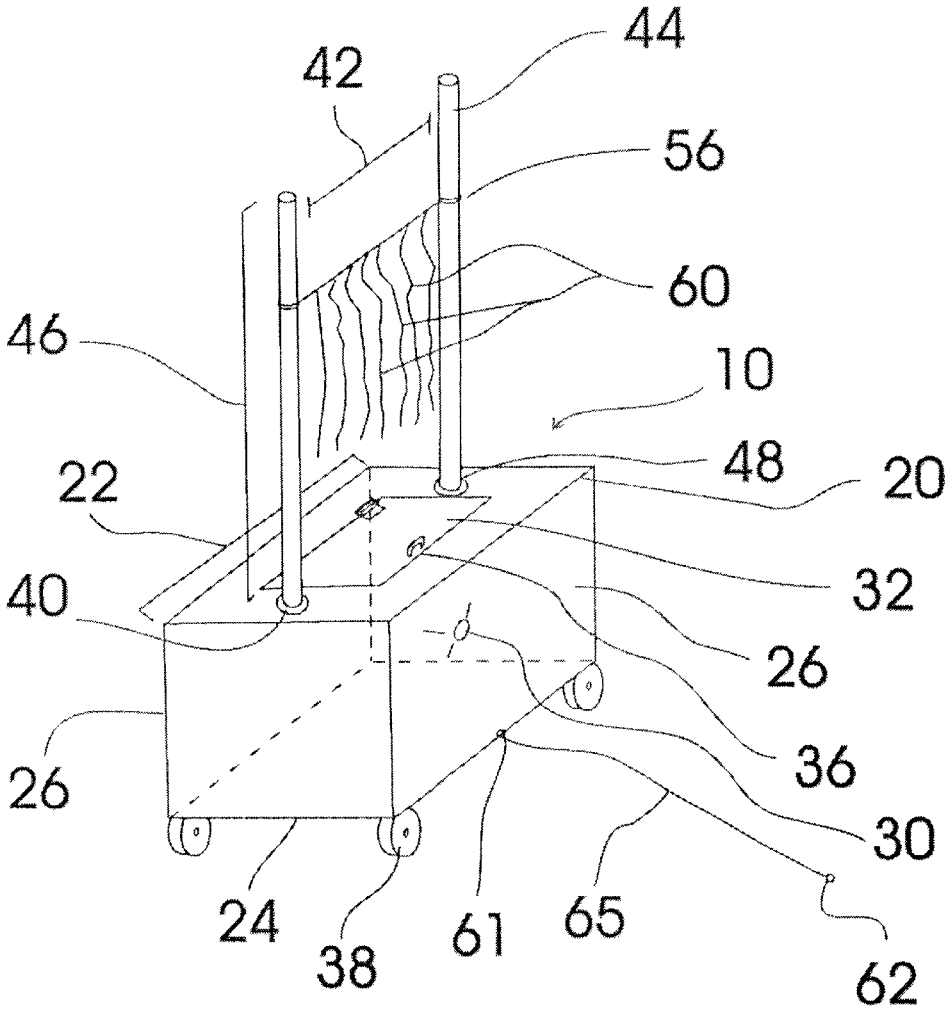
FIG. 1 is a perspective view of the invention.

Trajectory is a combination of vertical and horizontal force and angle between those combined perpendicular forces. The mathematical elements included within the physics of trajectory are horizontal force, vertical force and angle of trajectory. This current invention is a device for training football kickers to kick a ball at a given, calculated, pre-determined and measured angle of trajectory. This invention 10, as shown in FIG. 1 of the drawings, comprises a movable base 20, a pair of vertical uprights 44 mounted to the movable base 20, a horizontal trajectory indicator 52 slidably connected between the vertical uprights 44, and a plurality of vertically aligned contact indicators 60.

The movable base 20 is a hollow box having a width 22 of at least 4½ feet. The base 20 has a bottom 24, four sides 26, a top surface 28 is approximately one foot. The top surface 28 has a door 32 attached by hinges 34 within an opening 36 in such top surfaces 28 to allow access to the interior 30 of the base 20. Several wheels 38 are attached to the bottom 24 to allow the device 10 to be transported to a location for use.

Figure 2A:
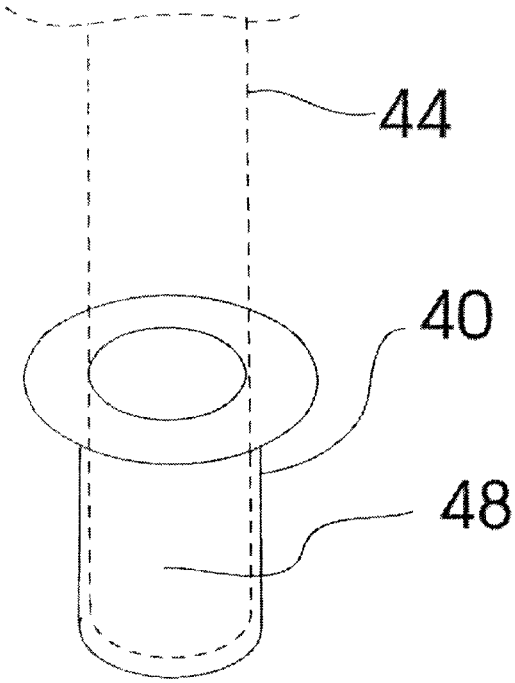
FIG. 2*a* is one embodiment of the upright mounting means.
Figure 2B:
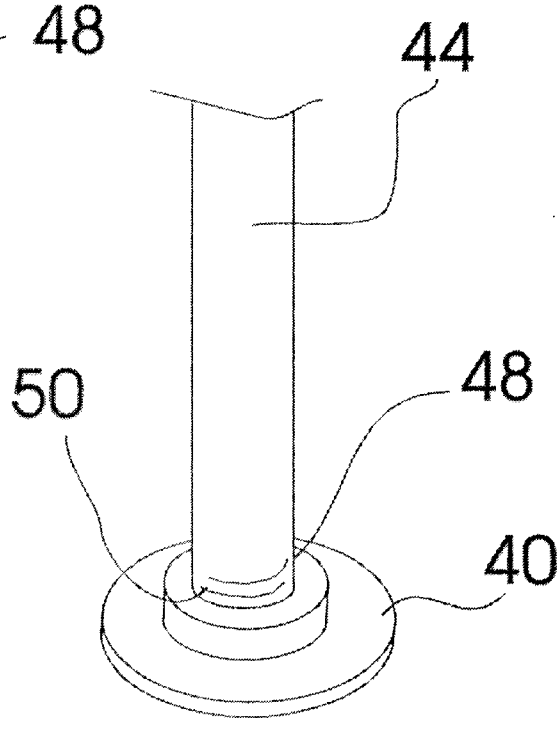
FIG. 2*b* is a second embodiment of the upright mounting means.
Figure 3:
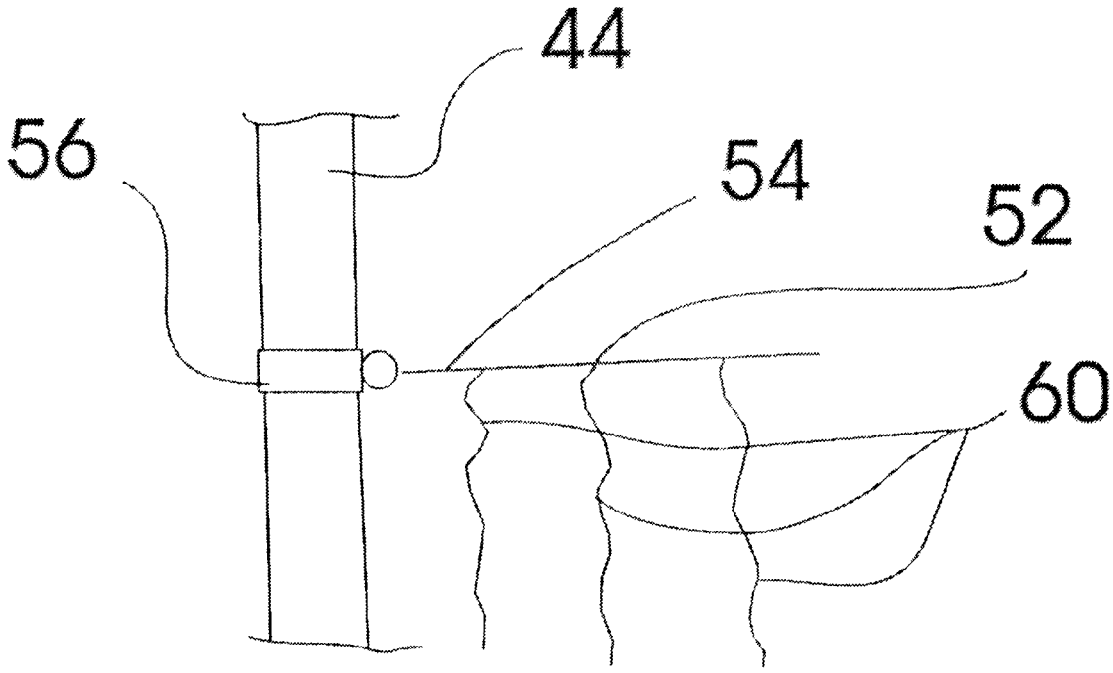
FIG. 3 is a close view of the adjustable trajectory indicator and the upright.

Affixed to the top surface 28 of the base 20, at a width 42 of at least four feet, are a pair of mounting means 40 within which the vertical uprights 44 are place. The pair of vertical uprights 44 are poles which have a length 46 and a bottom end 48 which may be provided with or without threads 50, depending on the mounting means 40. In one embodiment, as shown in FIG. 2*a* of the drawings, the mounting means 40 is a socket within which the uprights 44 are seated. In another embodiment, as shown in FIG. 2*b* of the drawings, the mounting means 40 is a threaded socket to accept a threaded bottom end 48 of the vertical uprights 44. It is preferred that the length 46 of the vertical uprights 44 be at least five feet, to provide sufficient adjustment height for a variety of kicking distances. The horizontal trajectory indicator 52, as shown in FIGS. 1 and 3 of the drawings, is an elastic cord having two ends 54 which are provided with loops 56. The trajectory indicator 52 is stretched and the loops 56 are placed upon the vertical uprights 44, thus situating the horizontal trajectory indicator 52 between the two vertical uprights 44 with tension. A plurality of vertically aligned contact indicators 60 are hung from the horizontal trajectory indicator 52. These contact indicators 60 may be permanently affixed or detachable. The contact indicators 60 are incorporated onto the trajectory indicator 52 to indicate contact by the kicked football, which ideally is kicked between the vertical uprights 44, above the movable base 20 and below the horizontal trajectory indicator 52.

The ideal kicking angle for a football to clear the line of scrimmage with a rushing defense is calculated to be 26°, thereby requiring a kicking trajectory pathway of a rise of 10 feet on a horizontal distance of 21 feet (the height required to clear a jumping person at the line of scrimmage from the seven yard distance between the holder and the center on the long snap). The horizontal trajectory indicator 52 is therefore set on the vertical uprights 44 to train the kicker to obtain that ideal angle of trajectory, imitating a live game situation.

As an option, a pre-calculated mathematic chart may be provided with the invention to indicate a height versus distance from the invention. Additionally, an embodiment of the invention may include the vertical uprights 44 having scored height indicators engraved into their length 46. A cord 65 having a first end attached to base 20 at point 61 and a second end extended to point 62 for placement of a football.

What is claimed is:

1. A portable kicking training device comprising:

a storage base having wheels;

a pair of removable uprights for compact storage within the base;

a mounting means for the uprights a moveable horizontal trajectory indicator attached to the two uprights, vertically slidable up and down the uprights depending on the distance the user chooses to practice; and a plurality of vertically aligned contact indicators hanging from the horizontal trajectory indicator;

the movable base being a hollow box having a width of at least 4½ feet, and including a bottom, four sides, and a top surface having a door hingedly attached thereto for allowing access to an interior of the movable base;

each of the pair of vertical uprights being a pole having a length and a bottom end;

the mounting means for the uprights including two sockets in connection with the top surface of the movable base, a bottom end of each removable upright being seated in each of the sockets during use;

the horizontal trajectory indicator being an elastic cord having two ends each provided with loop, the elastic cord being stretched and each loop slidably positioned one of the pair of vertical uprights.

2. The portable kicking training device of claim 1 wherein:

scored height indicators are engraved along each of the pair of vertical uprights.

3. The portable kicking training device of claim 1 further comprising:

a football kicking tee placement cord of a predetermined length having a first end secured to the moveable base and a second end positionable to indicate a positioning point for a football kicking tee; the predetermined length being selected to allow a user to have a 26 degree trajectory angle when the elastic cord is positioned between top ends of pair of vertical uprights.

* * * * *